US005982270A

United States Patent [19]

Wolfe, Jr. et al.

[11] Patent Number: 5,982,270

[45] Date of Patent: Nov. 9, 1999

[54] THERMAL FUSE

[75] Inventors: Melvin E. Wolfe, Jr., Hallstead, Pa.; Gary C. Berray, Port Crane, N.Y.; Robert C. Berfield, Jersey Shore, Pa.

[73] Assignee: Shop Vac Corporation, Williamsport, Pa.

[21] Appl. No.: 09/204,674

[22] Filed: Dec. 3, 1998

[51] Int. Cl.[6] ..... H01H 37/76; H01H 71/20

[52] U.S. Cl. ..... 337/401; 337/165; 337/178; 337/407

[58] Field of Search ..... 337/123, 165, 337/178, 190, 219, 317, 401, 407, 31, 52

[56] References Cited

U.S. PATENT DOCUMENTS

| | | | |
|---|---|---|---|
| 2,361,666 | 10/1944 | Triplett | 337/240 |
| 3,420,217 | 1/1969 | Powell et al. | 123/198 |
| 3,629,766 | 12/1971 | Gould, Jr. | 337/239 |
| 3,781,737 | 12/1973 | Henry | 337/407 |
| 4,065,741 | 12/1977 | Sakamoto et al. | 337/407 |
| 4,068,204 | 1/1978 | Iwanari et al. | 337/408 |
| 4,109,229 | 8/1978 | Plasko | 337/408 |
| 4,121,187 | 10/1978 | Mahieu | 337/171 |
| 4,126,845 | 11/1978 | Iimori et al. | 337/408 |
| 4,189,697 | 2/1980 | Hara | 337/407 |
| 4,203,086 | 5/1980 | Smith | 337/410 |
| 4,210,893 | 7/1980 | Hara | 337/407 |
| 4,276,532 | 6/1981 | Aoki | 337/408 |
| 4,360,725 | 11/1982 | Eeckhout | 219/253 |
| 4,383,236 | 5/1983 | Urani et al. | 337/403 |
| 4,441,093 | 4/1984 | Okazaki | 337/404 |
| 4,486,804 | 12/1984 | Watson et al. | 361/104 |
| 4,673,909 | 6/1987 | Schwob et al. | 337/407 |
| 4,789,800 | 12/1988 | Zimmermann | 310/68 C |

FOREIGN PATENT DOCUMENTS

| | | | |
|---|---|---|---|
| 000121005A1 | 10/1984 | European Pat. Off. | H01H 37/76 |
| 401072436A | 3/1989 | Japan | H01H 37/76 |
| 404019935A | 1/1992 | Japan | H01H 37/76 |
| 410177833A | 6/1998 | Japan | H01H 37/76 |

*Primary Examiner*—Leo P. Picard
*Assistant Examiner*—Anatoly Vortman
*Attorney, Agent, or Firm*—Marshall, O'Toole, Gerstein, Murray & Borun

[57] ABSTRACT

A thermal fuse includes a first electrical contact extending through and engaged in electrical contact with a second contact. A spring is compressed between the first and second contacts. A thermally deformable pin retains the second contact against the compressed spring. The pin is responsive to a high temperature condition such that the pin deforms, thereby allowing the spring to disengage the first and second contacts.

20 Claims, 2 Drawing Sheets

THERMAL FUSE

TECHNICAL FIELD

The present invention relates generally to thermal fuses, and more particularly, to a thermal fuse having a pair of electrical contacts that are retained in contact by a thermally deformable element.

BACKGROUND ART

Electrical appliances often include mechanisms that terminate operation of the motor in response to thermal overload conditions that could result in permanent damage to the motor or associated equipment. A thermal overload, such as an excessively high winding or rotor temperature, may occur as a result of a locked rotor, a high mechanical load, a supply overvoltage, a high ambient temperature, or some combination of these conditions.

Conventional thermal cut-outs (TCOs) are based on a thermally responsive element that fuses in response to a thermal overload condition, and which thereby interrupts the flow of electrical power to the protected apparatus, One typical approach uses a spring loaded contact pin or lead that is held in electrical connection with an opposing contact by a fusible material such as solder. Another typical approach uses one or more springs, which are independent from the electrical contacts, that drive the contacts apart into a displaceable fusible stop material. These known approaches have several significant drawbacks. In the first approach, the electrical power flows directly through the fusible material. Thus, self-heating in the fusible material itself, particularly in high power applications, can seriously impair the ability of the TCO to be responsive only to the temperature of the protected apparatus. In both described approaches, the TCO typically comprises a complex arrangement of springs and contact elements that are mounted in a housing. Thus, these approaches are costly, and do not allow for the direct inspection of the TCO because the fusible material and contact conditions are not usually visible through the housing.

SUMMARY OF THE INVENTION

In accordance with one aspect of the present invention, a first electrical contact extends through and is engaged with a second contact. A spring is disposed between the first and second contacts. A thermally deformable pin retains the first contact against the second contact. The pin is responsive to a high temperature condition such that the pin deforms, thereby allowing the spring to disengage the first and second contacts.

Preferably, the thermally deformable pin is made of a plastic material. Also preferably, the spring is a helical compression spring.

In accordance with another aspect of the present invention, a spring is compressed between a first electrical contact and a second electrical contact. A thermally deformable pin extends through the contacts and the spring. The pin is engaged with the first and second contacts, and is responsive to a high temperature condition such that the pin deforms and breaks under the expansive force of the spring to interrupt an electrical path between the first and second contacts.

DESCRIPTION OF THE PREFERRED EMBODIMENTS

Figure 1:
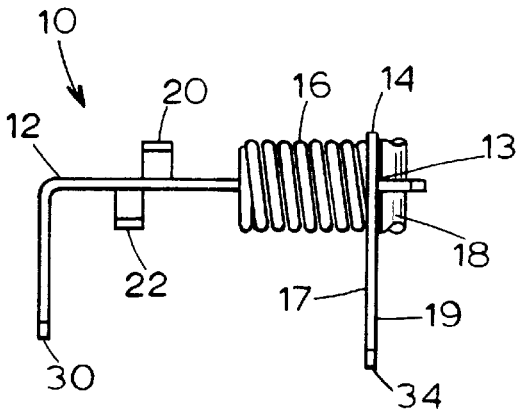
FIG. 1 is a front elevational view of an embodiment of the present invention.
Figure 2:
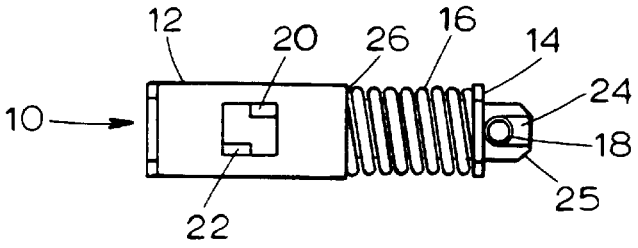
FIG. 2 is a bottom view of the embodiment of FIG. 1.
Figure 3:
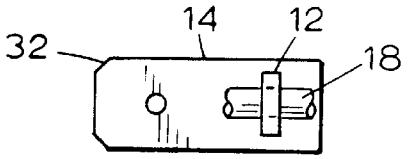
FIG. 3 is a side elevational view of the embodiment of FIG. 1.

Illustrated in FIGS. 1 and 2 is a thermal fuse 10 that embodies aspects of the present invention. The thermal fuse 10 includes a first electrical contact 12, a second electrical contact 14, a helical compression spring 16, and a thermally deformable pin 18, all preferably arranged as shown. The first contact 12 extends through a slot 13 (shown most clearly in FIG. 5) in the second contact 14 and makes electrical contact with the second contact 14. The spring 16 is retained in a compressed state between a first face 17 of the second contact 14 and a shouldered portion 26 of the first contact 12. The spring 16 is preferably made of metal, but may alternatively be made from a non-metallic, non-electrically conductive material without impairing the operation of the fuse 10. The thermally deformable pin 18 extends through a first opening 24 in the first contact 12 and the spring 16 urges a second face 19 of the second contact 14 into contact with the pin 18. The first contact 12 may additionally include mounting ears or tabs 20, 22 that facilitate mounting of the fuse 10 to a structural member (not shown) of a protected electrical apparatus (also not shown).

Figure 4:
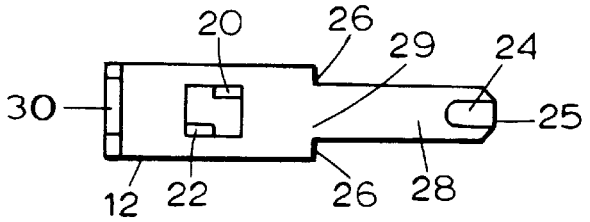
FIG. 4 is a plan view of one of the electrical contacts of FIG. 1.

Illustrated in FIG. 4 is a more detailed view of the first contact 12. As shown in FIG. 4, the first contact 12 has a spring guide portion 28 disposed at a first terminal end 29, and a second terminal end 30. The second terminal end 30 is preferably configured to accept a standard female spade connector. The spring guide 28 is an elongate tab that extends from the shouldered portion 26 of the contact 12. The spring guide 28 has a width that is smaller than the inner diameter of the spring 16 and a length that is substantially less than the free length of the spring 16. The first opening 24 is disposed at one end of the spring guide 28 and is dimensioned to easily accommodate the diameter or width of the thermally deformable pin 18.

Figure 5:
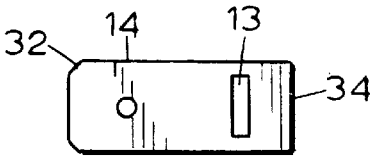
FIG. 5 is a plan view of the other electrical contact of FIG.1.

Referring now to FIG. 5, the second contact 14 has a first terminal end 32 that is preferably configured to accept a standard female spade connector. The slot 13 is disposed near a second terminal end 34 and is sized to accept the width and thickness of the spring guide 28 of the first contact 12. Thus, the spring guide 28 of the first contact 12 may easily extend through the second contact 14 via the slot 13. Although a rectangular geometry for the slot 13 is depicted, a variety of geometries could accomplish the desired result without departing from the spirit of the invention. For example, the opening may have a rounded rectangle geometry and/or may be unbounded (i.e., open) on one or more sides.

The first contact 12 and the second contact 14 are preferably made of metallic contact materials that are well known in the art. A particular material composition may be selected to optimize contact performance under the specific application conditions for current, voltage, environmental conditions, etc. The contacts 12, 14 are preferably fabricated using a stamping operation to keep costs low. For example, the mounting tabs 20, 22 may be semi-perforations that are formed directly from the metallic blank used to make the first contact 12.

The thermally deformable pin 18 is preferably cylindrical (although not necessarily) and is made of a thermoplastic material having a melting point above the normal operating temperature of the protected apparatus, but at or below an operating temperature encountered during, for example, an overload condition. For example, the fuse 10 may be mounted to an electric motor, and the pin material may be selected to soften in response to the elevated winding temperatures caused by a locked rotor condition.

Those of ordinary skill in the art will immediately recognize that a variety of other configurations and materials may be used for the pin 18 without departing from the spirit of the invention. For example, the pin 18 may have a rectangular profile, or may be a plastic rivet or plug. Alternatively, the pin 18 may be a threaded screw or bolt that threads into or passes through the first opening 24, or a Christmas tree-shaped plug. In addition, the pin 18 may be made from a variety of materials other than a thermoplastic. For example, metals having a low melting point such as lead or lead alloys could be used to achieve similar results.

In operation, the fuse 10 is mounted to or adjacent to the protected apparatus (not shown). For example, the fuse 10 may be mounted to the housing of an electric motor (not shown) via the mounting tabs 20, 22. A power leadwire for the motor is connected to the second terminal end 30 of the first contact 12, and a magnet wire from the motor winding is connected to the first terminal end 32 of the second contact 14. Thus, the fuse 10 is serially interposed in the power supplied to the motor. In an overload condition, the motor and surrounding ambient temperature increases. Accordingly, because the contacts 12, 14 of the fuse are thermally conductive and are in thermal connection to the motor and the surrounding ambient environment they heat the thermally deformable pin 18. The pin 18 softens in response to the overload temperatures, and if the elevated temperature is high enough and persists for a sufficient time the expansive force of the spring 16 will shear the pin 18 where it contacts the walls defining the first opening 24. Once the pin 18 has sheared, the spring 16 extends to its free length and disengages the second contact 14 from the first contact 12. Additionally, the wire attached to the first terminal end 32 of the second contact 14 tends to pull the second contact away from the free end of the spring 16 and the spring guide portion 28 of the first contact 12, thereby guaranteeing a break in the electrical path through the fuse 10.

Figure 6:
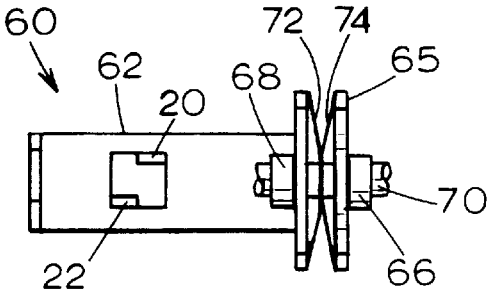
FIG. 6 is a bottom elevational view of another embodiment of the present invention.

Illustrated in FIG. 6 is another thermal fuse 60 that embodies aspects of the present invention. The thermal fuse 60 includes a first electrical contact 62, a second electrical contact 65, a thermally deformable pin 70, a first electrically conductive Belleville washer 72, and a second electrically conductive Belleville washer 74, all preferably arranged as shown. The Belleville washers 72, 74 are in a compressed state between the first and second contacts 62, 65. The pin 70 extends through the washers 72, 74 and the contacts 62, 65. The pin 70 is engaged with the contacts 62, 65, thereby retaining the washers 72, 74 in a compressed state and completing an electrical path between the first and second contacts 62, 65. The first contact 62 may additionally include the mounting tabs 20, 22.

Figure 7:
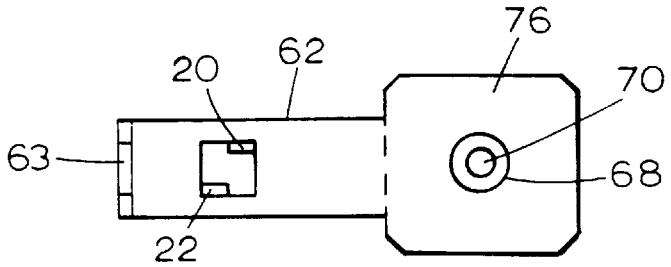
FIG. 7 is a plan view of one of the electrical contacts of FIG. 6.
Figure 8:
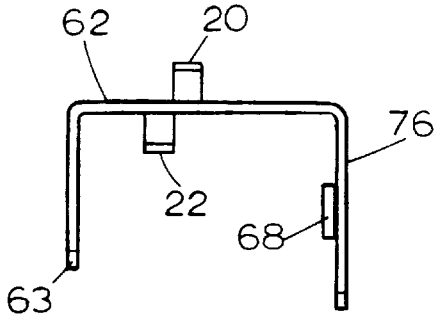
FIG. 8 is a front elevational view of one of the electrical contacts of FIG. 6.

Illustrated in FIG. 7 is a more detailed view of the first contact 62. As shown in FIG. 7, the first contact 62 has a first terminal end 63 and a second terminal end 76. The first terminal end 63 is preferably configured to accept a standard female spade connector. To ensure adequate electrical contact and uniform compression of the first Belleville washer 72, the second terminal end 76 is preferably dimensioned so that it completely engages the footprint of the first Belleville washer 72 in its compressed state. Thus, the length and width of the second terminal end 76 preferably equal or exceed the length and width or diameter of the first washer 72. The second terminal end 76 further includes a first opening 70 that is surrounded by a first extruded collar 68 (see also FIG. 8).

Figure 9:
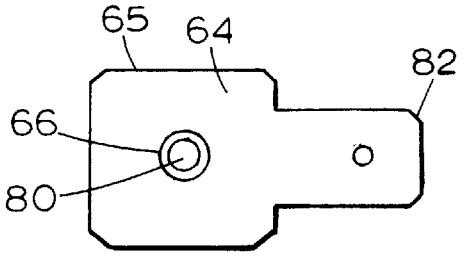
FIG. 9 is a plan view of one of the electrical contacts of FIG. 6.

Illustrated in FIG. 9 is a more detailed view of the second contact 65. The second contact 65 has a first terminal end 82 that is preferably configured to accept a standard female spade connector. The second contact has a second terminal end 64 that is preferably dimensioned identically to the second terminal end 76 of the first contact 62. Thus, the second Belleville washer 74 is engaged with the second terminal end 64 of the second contact 65 in a manner identical to that of the first washer's 72 engagement with the second terminal end 76 of the first contact 62. The second contact 65 includes a second opening 80 that is surrounded by a second extruded collar 66.

Figure 10:
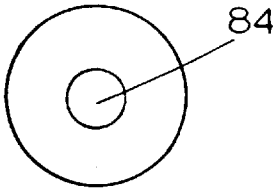
FIG. 10 is a plan view of a Belleville washer that may be utilized in the embodiment of FIG. 6.
Figure 11:
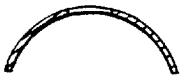
FIG. 11 is a front elevational view of the Belleville washer of FIG. 10.

Illustrated in FIGS. 10 and 11 are top and side views respectively of the first and second Belleville washers 72, 74. Each of the washers 72, 74 includes an opening 84 having a diameter substantially greater than the largest cross sectional dimension of the thermally deformable pin 70. The Belleville washers 72, 74 are preferably made from an electrically conductive material so that when they are compressed between the first and second contacts 62, 65 an electrical path is formed between the contacts 62, 65.

As shown in FIG. 6, the thermally deformable pin 70 extends through the first and second openings 70, 80, and through the openings 84 of the first and second washers 72, 74. The pin 70 is dimensioned so that it is frictionally engaged with or pressed into the first and second collars 68, 66, thereby retaining the washers 72, 74 in a compressed state and providing an electrical path between the first and second contacts 62, 65 through the conductive washers 72, 74. The specific materials and geometry of the contacts 62, 65 and the thermally deformable pin 70 may be similar to those used in connection with the first embodiment discussed above and shown in FIGS. 1 through 5.

In operation, the fuse 60 is mounted to or adjacent to the protected apparatus (not shown) in a manner similar to that used with first described embodiment. In an overload condition, the expansive force of the washers 72, 74 causes the pin 70 to extrude and break along its length. Once the pin 70 has broken, the first and second washers 72, 74 separate, thereby interrupting the electrical path between the first and second contacts 62, 65. Additionally, a lead wire attached to the third terminal end 82 of the second contact 65 tends to pull the second contact away from the first contact 62, thereby guaranteeing a break in the electrical path through the fuse 60.

Of course, it should be understood that a range of changes and modifications can be made to the preferred embodiment described above. For example, various types of springs may be substituted for the helical spring and Belleville washers shown in the preferred embodiments. It is therefore intended that the foregoing detailed description be regarded as illustrative rather than limiting and that it be understood that it is the following claims, including all equivalents, which are intended to define the scope of this invention.

What is claimed is:

1. A thermal fuse, comprising:

a first electrical contact having a first opening;

a second electrical contact having a second opening, the first electrical contact extending through the second opening and being engaged with the second contact;

a spring disposed between the first contact and the second contact; and a thermally deformable pin extending through the first opening and retaining the first contact against the second contact, the pin being responsive to a high temperature condition to cause the pin to deform such that the spring disengages the first and second contacts.

2. The fuse of claim 1, wherein the thermally deformable pin is made of a plastic material.

3. The fuse of claim 1, wherein the spring is a compression spring.

4. The fuse of claim 1, wherein the spring is a helical spring.

5. The fuse of claim 1, wherein the spring is electrically conductive.

6. The fuse of claim 1, wherein the first contact has a shouldered portion that provides a stop for the spring.

7. The fuse of claim 1, wherein the first and second contacts each have a terminal lug adapted for use with a female spade connector.

8. The fuse of claim 1, wherein the second opening is at least partially unbounded.

9. The fuse of claim 1, wherein the pin is substantially cylindrical.

10. The fuse of claim 1, wherein the pin is made of metal.

11. The fuse of claim 1, wherein one of the first and second contacts further includes at least one mounting member.

12. A thermal fuse, comprising:

a first electrical contact having a first opening;

a second electrical contact having a second opening;

a spring having a third opening; and a thermally deformable pin, the pin extending through said first, second and third openings and engaged with the contacts such that the spring is compressed between the first and second contacts, the pin further being responsive to a high temperature condition to cause the pin to deform such that the spring interrupts an electrical path between the first and second contacts.

13. The fuse claim 9, wherein the thermally deformable pin is made of a plastic material.

14. The fuse of claim 9, wherein the spring is a flat spring.

15. The fuse of claim 9, wherein the spring is a Belleville washer.

16. The fuse of claim 9, wherein the spring is electrically conductive.

17. The fuse of claim 9, wherein the first and second contacts each have a terminal lug adapted for use with a female spade connector.

18. The fuse of claim 12, wherein the pin is substantially cylindrical.

19. The fuse of claim 12, wherein the pin is made of metal.

20. The fuse of claim 12, wherein one of the first and second contacts further includes at least one mounting member.

* * * * *